United States Patent [19]

McIntyre

[11] 4,176,347

[45] Nov. 27, 1979

[54] RESTRAINING BAR WITH ALARM

[76] Inventor: Lorraine E. McIntyre, 828 S. Los Robles, Pasadena, Calif. 91106

[21] Appl. No.: 794,826

[22] Filed: May 9, 1977

[51] Int. Cl.[2] ..... G08B 13/06

[52] U.S. Cl. ..... 340/545; 200/61.93

[58] Field of Search ..... 340/274 R, 545; 200/61.93, 61.62

[56] References Cited

U.S. PATENT DOCUMENTS

| | | | |
|---|---|---|---|
| 3,444,546 | 5/1969 | Hawkins | 340/274 R |
| 3,587,080 | 6/1971 | Hawkins | 340/274 R |

*Primary Examiner*—Glen R. Swann, III

*Attorney, Agent, or Firm*—Edgar W. Averill, Jr.

[57] ABSTRACT

A restraining bar is pivotally mounted to slide on a support affixed to the inner surface of a door. In its locked position, it is under a restraining means affixed to the door's latch-frame casement. A switch is situated between the restraining bar and the support so that movement of the door when the restraining bar is in its locked position will cause the restraining bar to pivot toward the support and thereby close the switch to actuate an alarm.

9 Claims, 3 Drawing Figures

FIG. 1.
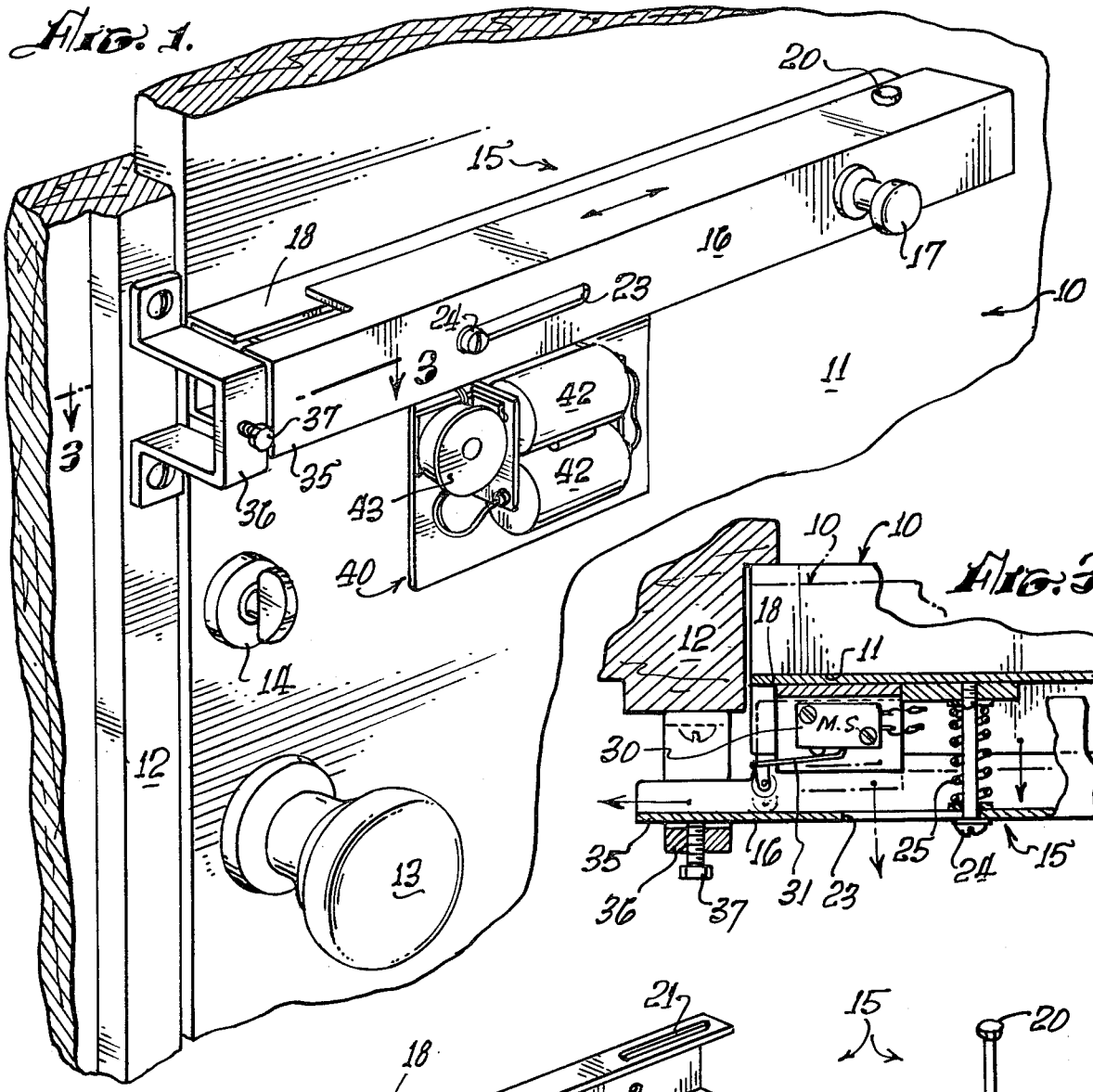
FIG. 3.
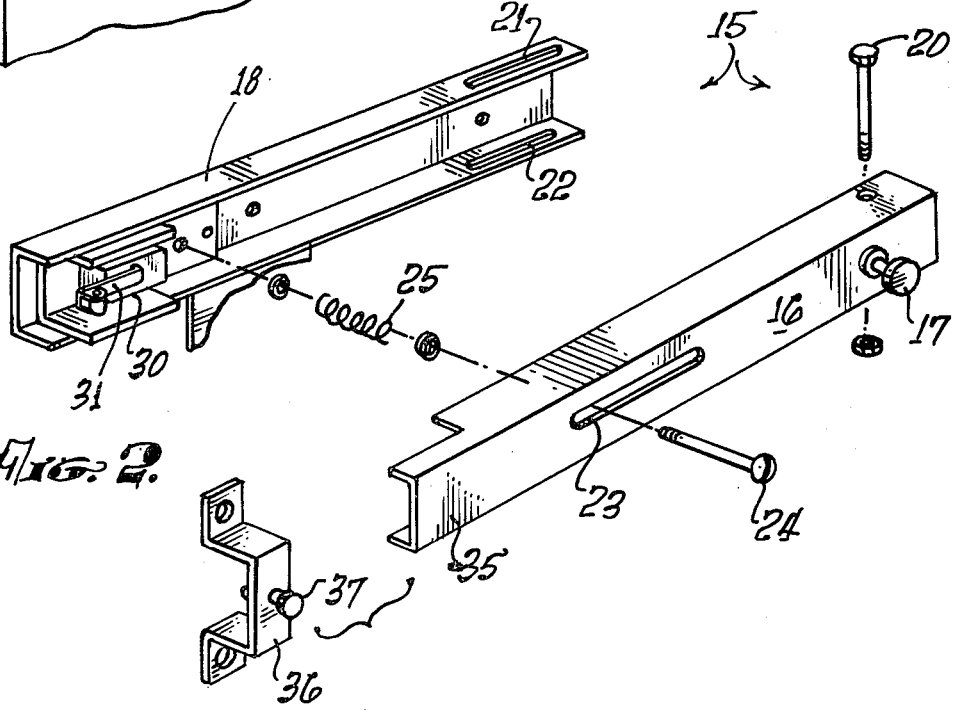
FIG. 2.

RESTRAINING BAR WITH ALARM

BACKGROUND OF THE INVENTION

The field of the invention is alarm devices and the device more particularly relates to alarms for signaling the unwanted attempt to open a latched door. Whereas latch devices are commonly used to lock a door from the inside, many latch devices may be defeated by an intruder particularly the widely used chain and latch method which can be opened if not properly installed.

Various noise-making devices are also widely used to call attention to an intruder utilizing conductive tapes, switches both magnetic and mechanical which are commonly connected to a bell, horn or other noise maker. While such devices do sound an alarm or trigger a silent alarm, such devices do not, in themselves, help prevent an opening of the door. Furthermore, if not deactivated, these alarms are readily sounded by mistake and tend to lose effectiveness because of this.

SUMMARY OF THE INVENTION

It is thus an object of the present invention to provide an alarm device for an inwardly opening door which device not only sounds an alarm if the door is forced open but also helps to hold the door in a closed or locked position.

It is a further object of the present invention to provide an alarm device which is easily deactivated to reduce the unwanted sounding of alarm.

The present invention is for an alarm device mounted between a door and its latch-frame casement and activated by a slight movement of the door. The device is useful on inwardly opening doors and is mounted on the inside surface of the door and cooperates with a latch holding member positioned on the latch-frame casement of the door. Support means are affixed against the inside surface of the door and bar means are pivotally held by the support means against the inside surface of the door. One end of the bar means is affixed in a detachable manner to the latch frame casement and switch means are held between the support means and the bar means. When the bar means is affixed to the latch frame, any attempt to open the door moves the bar means with respect to the support means and a switch is closed turning on an alarm or setting off a silent alarm.

By moving the bar to an open position away from the latch frame, the door may be readily opened and closed without sounding the alarm. The bar means is held to the support means by a track located near the end of the support means which is farthest from the latch frame. A particularly effective device results when the track means is a pair of slots located in a channel member which comprises the support means. When the bar is another channel member fitting over the support channel member and held thereto by a pin positioned in the slot of the support member, an especially effective alarm and latch member results.

BRIEF DESCRIPTION OF THE DRAWINGS

FIG. 1 is a perspective view of the alarm and latch device of the present invention mounted on a door and door frame.

FIG. 2 is a perspective exploded view of the alarm device of FIG. 1.

FIG. 3 is a plan view partly in cross section taken along line 3—3 of FIG. 1

DESCRIPTION OF THE PREFERRED EMBODIMENTS

An inwardly opening door 10 has an inside surface 11 and is closed in a conventional manner into a latch frame casement 12. A door handle 13 and a lock 14 are conventional.

The alarm device of the present invention is indicated generally by reference character 15 and is mounted on the inside door surface 11. Alarm 15 has a bar 16 which slides longitudinally over a support 18 which is affixed to door 10. A handle 17 facilitates the sliding of bar 16. As shown most clearly in FIG. 2, bar 16 has a pin 20 which fits through a pair of slots 21 and 22 formed in the side of support 18. When pin 20 is installed through slots 21 and 22, the assembly forms a track means which allows the bar to move longitudinally with respect to the support. A slot 23 is formed in bar 16 and a screw 24 fits through slot 23 and around spring 25 and is threaded into the base of the support 18. Screw 24 and spring 25 serve to hold bar 16 at a fixed position away from support 18. Bar 16 can be moved inwardly with respect to the support and thereby compresses spring 25 and activates switch 30 in a manner more clearly set forth below. Switch 30 may be a micro-switch having an arm 31 which contacts the inner surface of bar 16 as shown most clearly in FIG. 3. In operation, after the door is closed, bar 16 is moved longitudinally so that its latching end 35 passes under holder 36 which is affixed to latch frame casement 12. An adjustment screw 37 may be used to set the alarm so that a very small movement of door 10 will activate switch 30. As shown in FIG. 3, if an attempt is made to open the door when latching end 35 is positioned under holder 36, the support 18 and the switch 30 which is attached thereto will move but the bar 16 will not. The moved door and support is shown in phantom lines in FIG. 3 and the movement of arm 31 by its contact with bar 16 closes the contacts of switch 30 and sets off the alarm 40. Alarm 40 comprises a battery-operated horn having batteries 42 and horn 43. By mounting the horn directly on the door, the sound of the alarm is amplified by the door surface acting as a sounding board.

By sliding bar 16 to an open position, the door, of course, can be freely opened and closed without sounding the alarm.

It has been found that noise is one of the most effective means of preventing burglary and the mounting of the alarm directly on the door tends to amplify the sound and generate the noise at the point where it is most effective, namely at the point of undesired intrusion. Unlike most alarm devices the present device may be readily deactivated from the inside and even if set off by mistake is readily turned off and need not unnecessarily disturb neighbors.

While the switch is shown mounted in the support it could, of course, be mounted on the bar with the same effect. Likewise, while the slots are shown located in the support, they could alternatively be located in the bar with a pin or pair of pins located in the support. Other track means could be used in place of the pin and slot shown in the drawings.

A particularly light, attractive and easily fabricated alarm may be made by the use of aluminum channel members similar to those shown in the drawing. It is of course possible that the alarm device of the present invention could be mounted on the latch-frame casement of the door rather than on the door surface itself but this mounting is equivalent of the present mounting since contact with the inner surface of the door is still necessary.

I claim:

1. An alarm device mounted between a door and its latch frame-casement and activated by a slight movement of the door from its closed position when the device is in its locked configuration, said alarm device comprising:

an inwardly opening door having an inside surface and an outside surface, said door being mounted in a doorframe having a hinge-frame casement and a latch frame casement;

support means affixed against the inside surface of the door;

bar means pivotally and slidingly held by said support means near the end of said support means which is farthest from the latch-frame casement, said bar means being held against the inside surface of the door and having one end affixed in a detachable manner to said latch-frame casement;

switch means held between said support means and said bar means, said switch means being activated by a slight movement of said bar means toward said support means; and alarm means activated by said switch means whereby an attempt to open said door, when said bar means is affixed to said latch-frame casement, causes said alarm to sound.

2. The device of claim 1 wherein said bar means is held to said support means by track means located near the end of said support means which is farthest from the latch frame.

3. The device of claim 2 wherein said track means has a pair of slots with pin means passing therethrough.

4. The device of claim 1 wherein said support means is a channel member.

5. The device of claim 4 wherein said bar means is a channel member larger than said support means and positioned to cover the majority of said support means.

6. The device of claim 4 wherein said support means has a pair of slots formed near the end of said support member which is farthest from the latch frame and said bar means is held to said support member by pin means affixed to said bar means.

7. The device of claim 6 wherein said bar means is detachably held to said latch frame casement by a holder into which the end of said bar means may pass, which holder is affixed to said latch frame casement.

8. The device of claim 4 wherein said switch means is a microswitch mounted within said support means and having a finger touching the bar means.

9. The device of claim 8 wherein said alarm means is affixed to the inside surface of said door.

* * * * *